US008282051B2

(12) United States Patent
Nutaro et al.

(10) Patent No.: US 8,282,051 B2
(45) Date of Patent: Oct. 9, 2012

(54) ARMREST ASSEMBLY

(75) Inventors: Joseph Nutaro, Phoenix, AZ (US); Steven Grothe, Cave Creek, AZ (US)

(73) Assignee: Honeywell International Inc., Morristown, NJ (US)

( * ) Notice: Subject to any disclaimer, the term of this patent is extended or adjusted under 35 U.S.C. 154(b) by 192 days.

(21) Appl. No.: 12/815,947

(22) Filed: Jun. 15, 2010

(65) Prior Publication Data

US 2011/0303802 A1 Dec. 15, 2011

(51) Int. Cl.
*B68G 5/00* (2006.01)

(52) U.S. Cl. ..... 248/118

(58) Field of Classification Search ..... 248/118, 248/118.1, 118.3, 118.5; 296/1.09, 153; 297/411.2, 411.24, 411.35
See application file for complete search history.

(56) References Cited

U.S. PATENT DOCUMENTS

| | | | | |
|---|---|---|---|---|
| 5,201,485 | A * | 4/1993 | Moss et al. | 248/118 |
| 5,383,632 | A * | 1/1995 | Shirlin et al. | 248/118.5 |
| 5,398,896 | A * | 3/1995 | Terbrack | 248/118.5 |
| 6,056,247 | A | 5/2000 | Hoglund | |
| 6,203,109 | B1 * | 3/2001 | Bergsten et al. | 297/411.35 |
| 6,454,224 | B1 * | 9/2002 | Nogueira | 248/118.5 |
| 2009/0096258 | A1 | 4/2009 | Kim | |
| 2009/0288123 | A1 | 11/2009 | Havlovick et al. | |

FOREIGN PATENT DOCUMENTS

| | | | |
|---|---|---|---|
| DE | 102006018537 | A1 | 11/2007 |
| DE | 102009008728 | A1 | 10/2009 |
| DE | 102009008727 | A1 | 11/2009 |
| EP | 1350669 | A2 | 10/2003 |

OTHER PUBLICATIONS

EP Communication, EP 11169573.0-1264 dated Dec. 6, 2011.
EP Search Report, EP 11169573.0-1264 dated Oct. 21, 2011.

* cited by examiner

*Primary Examiner* — Ramon Ramirez
(74) *Attorney, Agent, or Firm* — Ingrassia Fisher & Lorenz, P.C.

(57) ABSTRACT

An armrest assembly for use with a first control device and a second control device arranged generally in a tandem configuration is disclosed herein. The armrest assembly includes, but is not limited to, a base member configured for mounting to the horizontal surface proximate the first control device in a position aligned with the first and the second control devices. The armrest assembly also includes an arm support member movably mounted to the base member. The arm support member is configured to move between a first position and a second position. The arm support member is configured to steady a user's arm when accessing the first control device when the arm support member is in the first position. The arm support member is further configured to steady the user's arm when accessing the second control device when the arm support member is in the second position.

18 Claims, 13 Drawing Sheets

ARMREST ASSEMBLY

TECHNICAL FIELD

The present invention generally relates to armrest assemblies, and more particularly relates to armrest assemblies for use with a first control device and a second control device arranged in tandem.

BACKGROUND

Control devices including, but not limited to, touch screens, keyboards, and cursor control devices (e.g., track balls) are used in the operation and control of vehicles. Such control devices are commonly used, for instance, in aircraft, spacecraft, water craft and automobiles. These control devices are frequently mounted on horizontal surfaces. For instance, the center pedestal located between a pilot and a co-pilot may include such control devices. In many instances, two or more control devices are arranged on the center pedestal or other surfaces within the flight deck and are arranged in tandem or are otherwise longitudinally aligned.

During vehicle operations, the vehicle frequently encounters disruptive motion of some sort. For example, an aircraft may encounter turbulence, a water craft may bounce from wave to wave, an automobile may encounter pot holes, speed bumps, etc. . . . . Under such circumstances, vehicle operators may have difficulty in keeping their hands steady as they attempt to use the control devices. This can result in the typing of an incorrect letter on a keyboard, the selection of an undesired menu option with a cursor control device, or the touching of an undesired graphic button using a touch screen.

One solution has been to provide a raised surface proximate the control device on which vehicle operators may rest their hands. This allows vehicle operators to keep their hands substantially steady and immobile with respect to the control device that they are manipulating. This solution is adequate when vehicle operators are presented with a single control device, but when there are two or more such control devices aligned longitudinally, the raised surface may be adequate only for the proximate control device. The vehicle operator will still have to manipulate the distal control devices with an unsupported hand.

BRIEF SUMMARY

An armrest assembly for use with a first control device and a second control device arranged in a generally in tandem configuration is disclosed herein.

In a first embodiment, the armrest assembly includes, but is not limited to, a base member that is configured for mounting to a surface proximate the first control device in a position that is generally longitudinally aligned with the first control device and the second control device, and an arm support member that is movably mounted to the base member. The arm support member is configured to move between a first position and a second position. The arm support member is configured to steady a user's arm while accessing the first control device when the arm support member is in the first position. The arm support member is further configured to steady the user's arm while accessing the second control device when the arm support member is in the second position.

In a second embodiment, the armrest assembly includes, but is not limited to, a base member that is configured for mounting to a surface proximate the first control device in a position that is generally longitudinally aligned with the first control device and the second control device, and an arm support member that is rotatably mounted to the base member. The arm support member is configured to rotate between a first position and a second position. The arm support member is configured to steady a user's arm when accessing the first control device when the arm support member is in the first position. The arm support member is further configured to steady the user's arm when accessing the second control device when the arm support member is in the second position.

In a third embodiment, the armrest assembly includes, but is not limited to, a base member that is configured for mounting to a surface proximate the first control device in a position that is generally longitudinally aligned with the first control device and the second control device, and an arm support member that is mounted to the base member via a two bar linkage and configured to articulate between a first position and a second position. The arm support member is configured to steady a user's arm when accessing the first control device when the arm support member is in the first position. The arm support member is further configured to steady the user's arm when accessing the second control device when the arm support member is in the second position.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

An improved armrest assembly is disclosed herein that is adapted to support a user's arm against unintended movement caused by motion of a vehicle as the user accesses two control devices arranged in tandem. The armrest assembly is longitudinally aligned with the two control devices and includes a base and an arm support member that is movably mounted on the base. The arm support member moves between a first position and a second position. While in the first position, the arm support member is configured to support a user's arm as the user manipulates the control device located closest to the armrest assembly. While in the second position, the arm support member is configured to support the user's arm as the user manipulates the control device located remotely from the arm support member.

A further understanding of the armrest assembly disclosed herein may be obtained through a review of the illustrations accompanying this application together with a review of the detailed description that follows.

Figure 1:
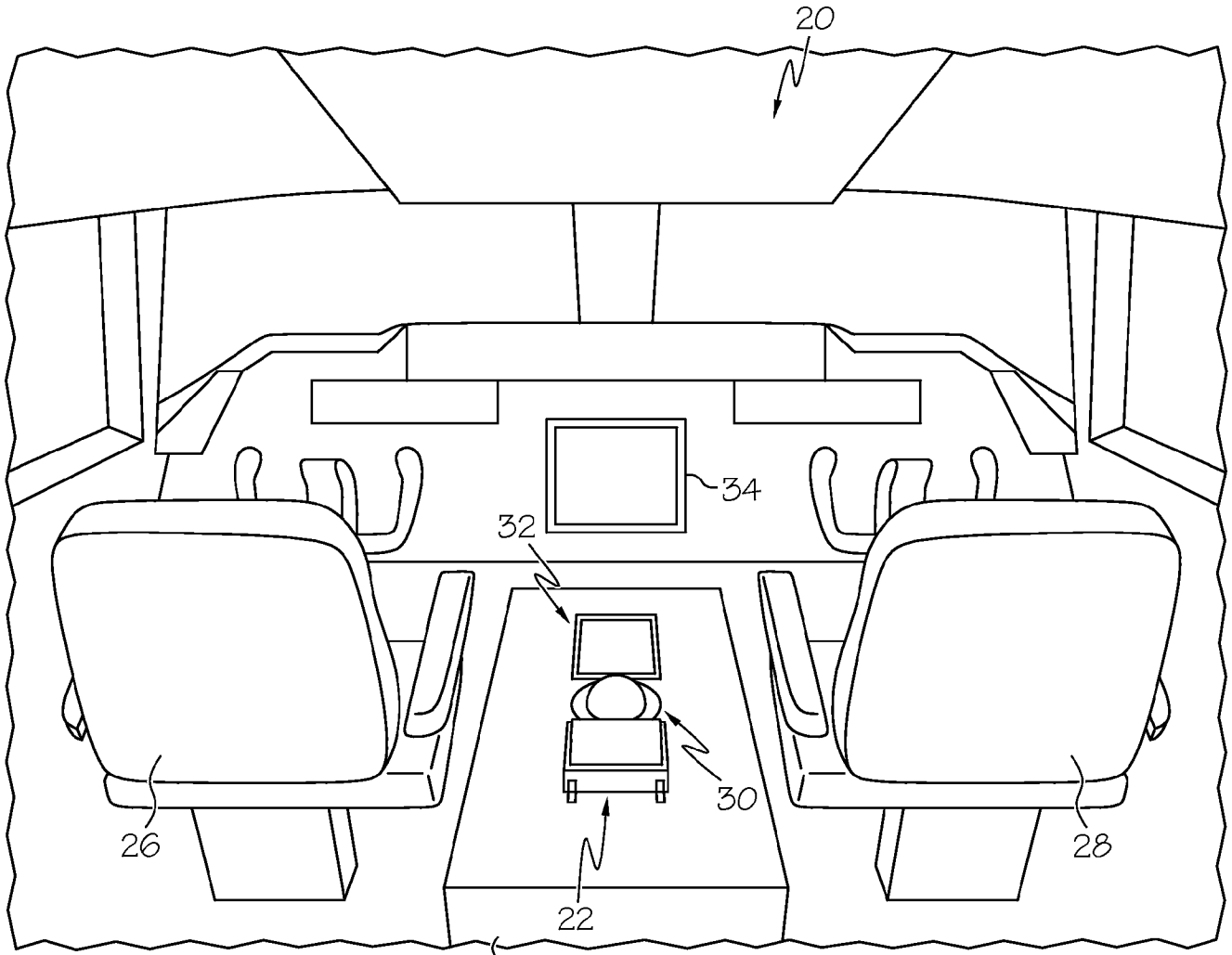
FIG. 1 is a perspective view illustrating an aircraft flight deck including an embodiment of an armrest assembly made in accordance with the teachings of the present disclosure.

FIG. 1 is a perspective view illustrating an aircraft flight deck 20 including an embodiment of an armrest assembly 22 made in accordance with the teachings of the present disclosure. While the context of this discussion is that of an aircraft, it should be understood that armrest assembly 22 is not limited to use with aircraft. Rather, armrest assembly 22 is compatible with any type of vehicle including spacecraft, watercraft, and vehicles adapted to travel over land. Although the drawings illustrate the center console in an aircraft, the armrest can be located in any location in the aircraft that supports the access to the control devices.

Armrest assembly 22 is mounted to a center pedestal 24, which is positioned between a pilot seat 26 and a co-pilot seat 28. A first control device 30 and a second control device 32 are mounted to center pedestal 24 where they are each accessible to both a pilot and a co-pilot. In FIG. 1, first control device 30 is a track ball that may be used to control a cursor on a flight display 34 and second control device 32 is a touch screen control panel that may be used to control various functions of the aircraft. In other embodiments, first and second control devices 30 and 32 may both be touch screen control panels or may both be track balls, or each may be any of a wide variety of other types of control devices including, but not limited to, touch pads, key boards, knobs, switches, buttons, and dials.

First and second control devices 30 and 32 are arranged in tandem on center pedestal 24, with second control device 32 being positioned forward of first control device 30. Armrest assembly 22 is located rearward of first control device 30 and is generally longitudinally aligned with both first control device 30 and second control devices 32. The terms "forward" and "rearward", as used herein, are with reference to the direction of vehicle travel. A pilot or co-pilot can rest their hand or a portion of their arm on armrest assembly 22 to stabilize their hand with respect to center pedestal 24. Additionally, as discussed in detail below, a portion of armrest assembly 22 is configured to move as the pilot or co-pilot moves their hand between first and second control devices 30 and 32. In this manner, armrest assembly 22 can provide continuous stabilizing support to a hand or arm, and thereby make it less likely that any inadvertent control inputs will be input into either first control device 30 or second control device 32 as the pilot or co-pilot manipulates these control devices.

Figure 2:
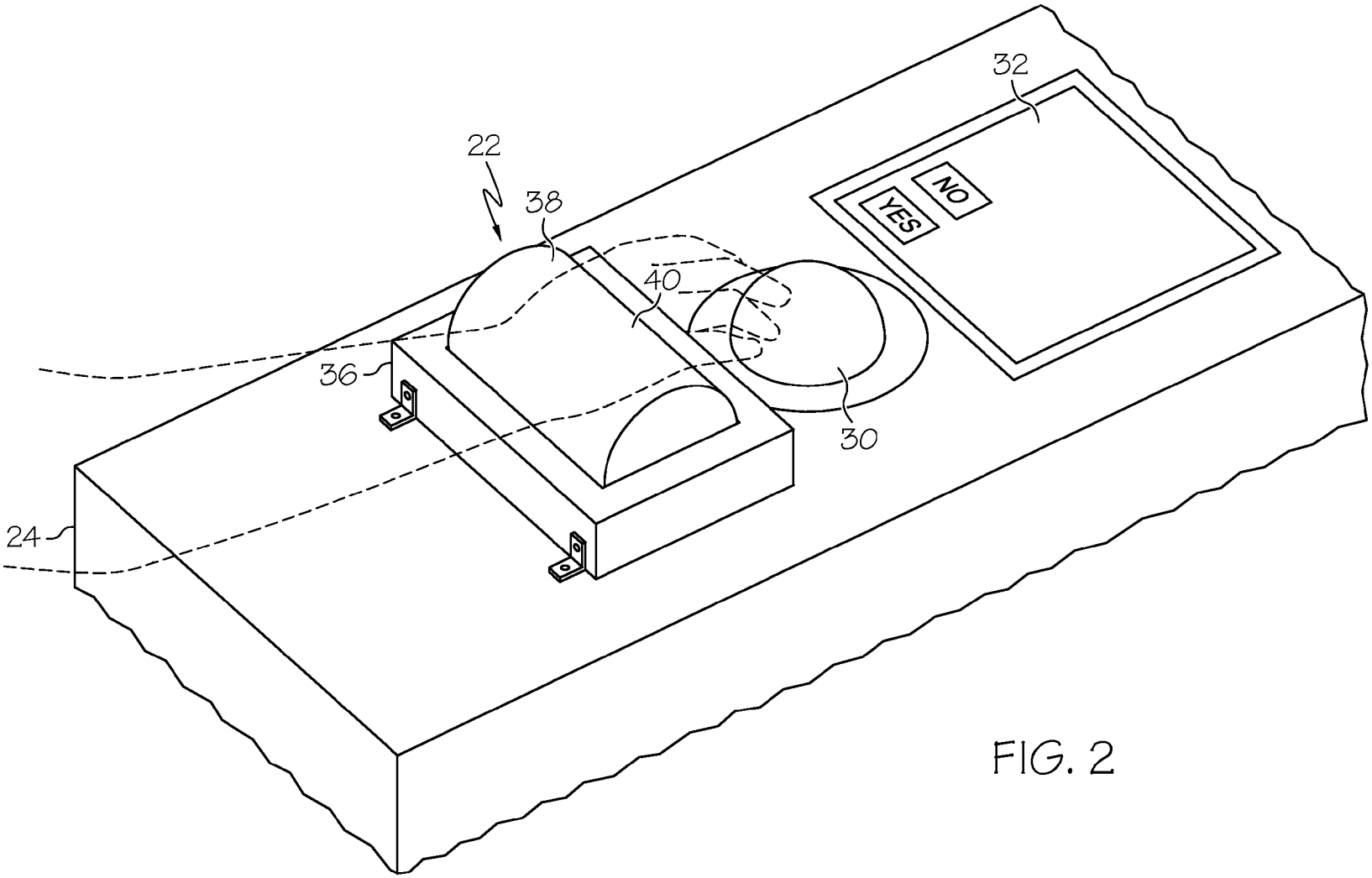
FIG. 2 is an expanded perspective view illustrating the armrest assembly of FIG. 1 with an arm support member in a position to support a user's palm.

FIG. 2 is an expanded perspective view illustrating the armrest assembly 22 of FIG. 1. Armrest assembly 22 includes a base member 36 and an arm support member 38. Arm support member 38 is rotatably mounted to base member 36 and is configured to rotate between a first position (shown in FIG. 2) and a second position (shown in FIG. 3). As discussed below, alternate embodiments configured to permit other types of movement of arm support member 38 are contemplated by this disclosure.

While in the first position, arm support member 38 presents a surface 40 having a generally convex contour. This configuration is well suited for receiving the palm of a person's hand, as illustrated by the hand and arm portion drawn in phantom lines. With a person's palm resting on the convex surface of arm support member 38, the person's fingers can easily access and manipulate first control device 30.

Figure 3:
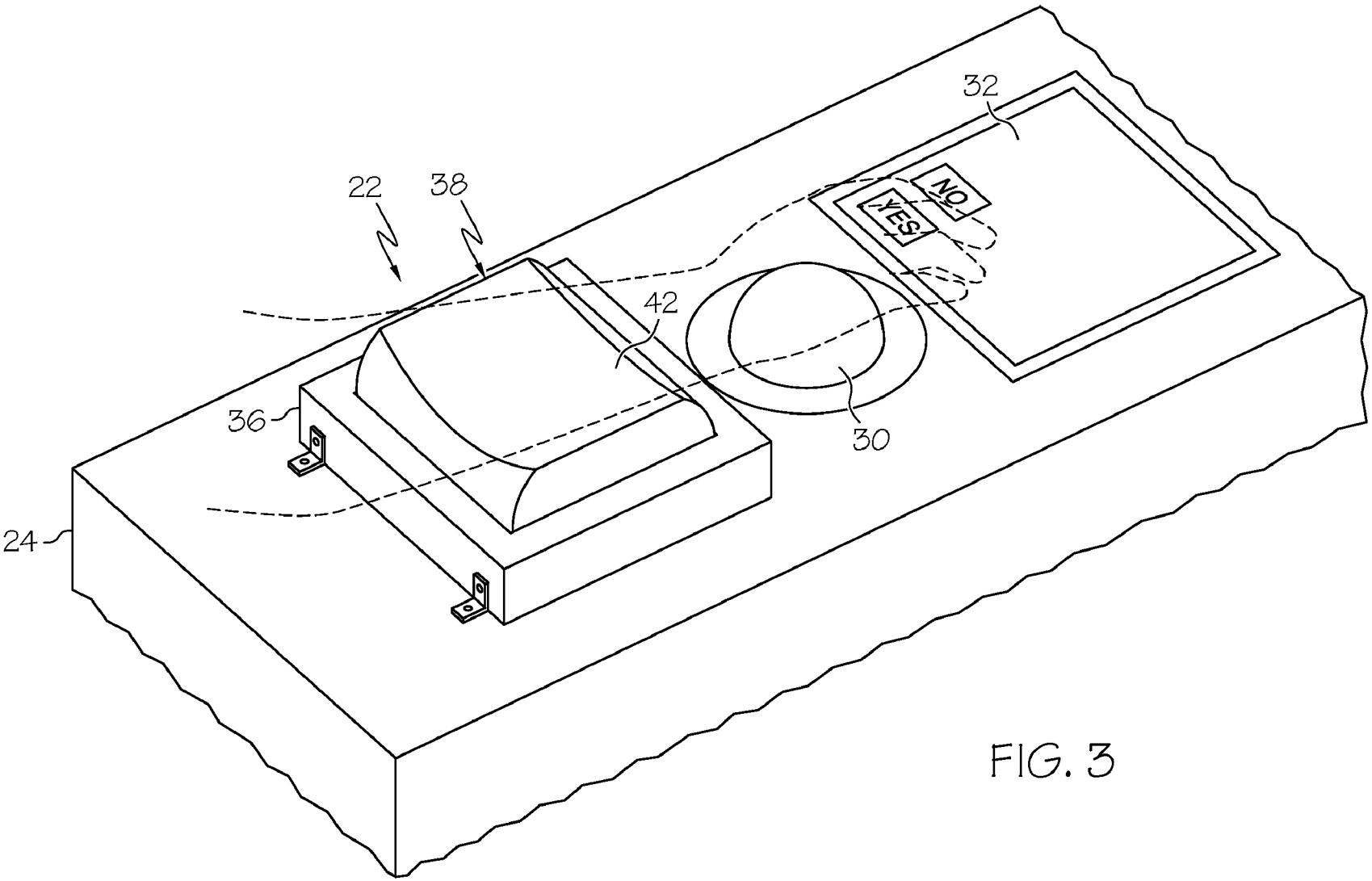
FIG. 3 is a perspective view illustrating the armrest assembly of FIG. 2 with the arm support member in a position to support a user's wrist/forearm.

FIG. 3 is a perspective view illustrating armrest assembly 22 with arm support member 38 in a position to support a user's wrist/forearm. In FIG. 3, arm support member 38 has rotated to the second position, exposing a surface 42 having a generally concave contour. The shallow portion of surface 42 is aligned with first and second control devices 30 and 32, making it well suited for a person to rest either their wrist or a portion of their forearm on surface 42. With a person's wrist/forearm resting on surface 42, the person's arm is stabilized with respect to center pedestal 24 and their fingers are positioned in close proximity to second control device 32 as illustrated by the hand and arm portion drawn in phantom lines. Although the embodiment illustrated in FIGS. 2 and 3 include a convex surface (surface 40) and a concave surface (surface 42), it should be understood that other geometric configurations, including, but not limited to, flat configurations may also be employed.

Figure 4:
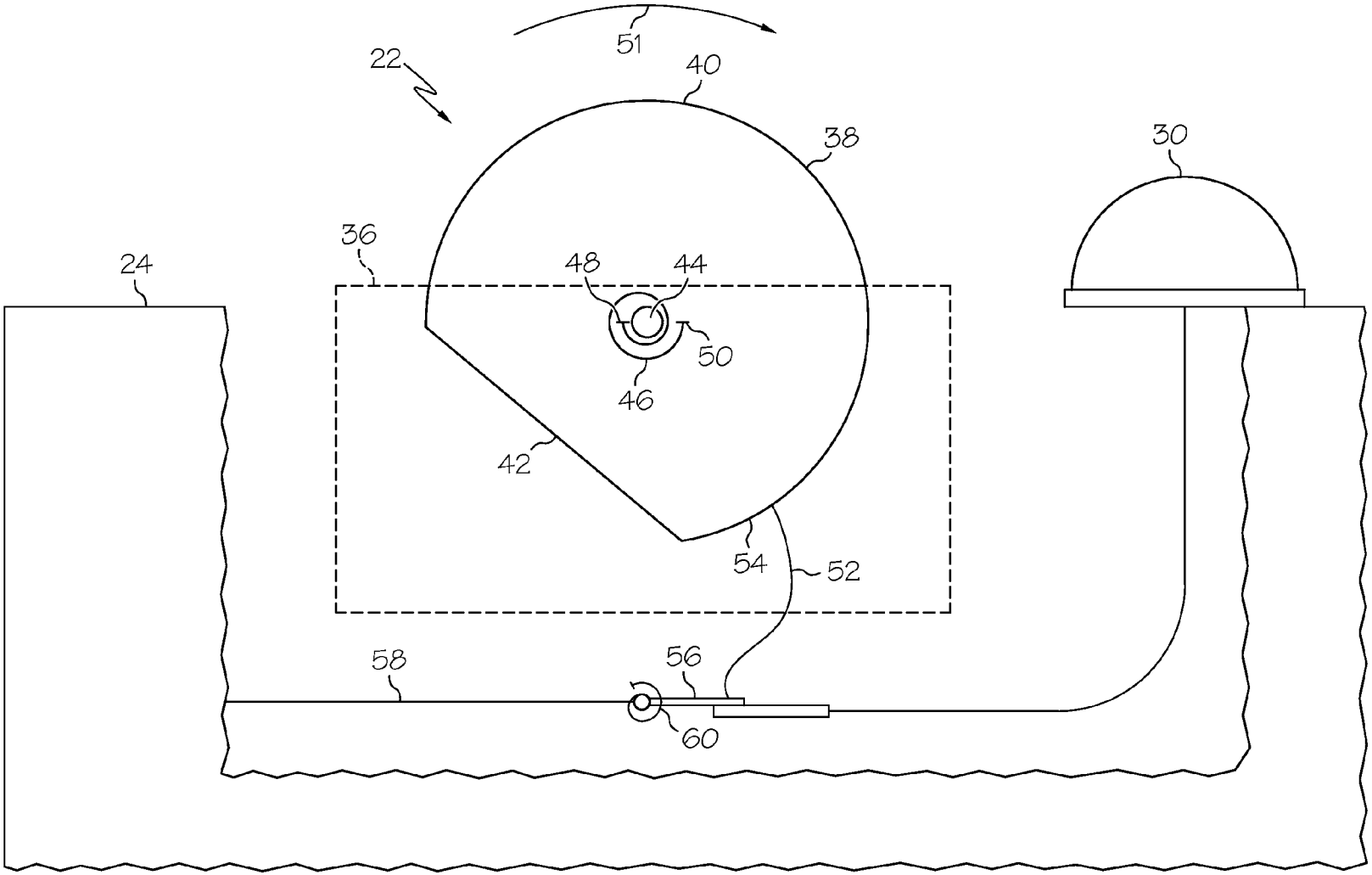
FIG. 4 is a schematic side view illustrating various features of the armrest assembly of FIG. 1 with the arm support member in a position to support a user's palm.

FIG. 4 is a schematic side view illustrating various features of armrest assembly 22 with arm support member 38 in a position to support a user's palm. In the illustrated embodiment, Arm support member 38 is generally configured as a wheel with surfaces 40 and 42 spaced apart from one another at a periphery of arm support member 38. In differing embodiments, the circumferential distance between surface 40 and surface 42 will vary to correspond with the longitudinal distance between first and second control devices 30 and 32. In other embodiments, arm support member 38 may not be configured as a wheel, but may instead have different geometric configurations.

Arm support member 38 is mounted to base member 36 via a pin 44 extending through arm support member 38 and about which arm support member 38 rotates. In other embodiments, alternate configurations suitable for providing a rotational relationship between base member 36 and arm support member 38 may be employed without departing from the teachings of the present disclosure. With a person's palm resting on surface 40, the person need only move their arm forward while maintaining contact with arm support member 38 and arm support member 38 will rotate in a clockwise direction (from the perspective of FIG. 4), thus exposing surface 42 which aligns with and cradles the person's wrist or forearm, depending upon the dimensions of the person's arm.

Armrest assembly 22 further includes a torsion spring 46 connected at a first end 48 to base member 36 and at a second end 50 to arm support member 38. As a person moves their arm forward (i.e., in the direction indicated by arrow 51) and arm support member 38 rotates to expose surface 42, torsion spring 46 stores energy. When the person's arm is lifted from arm support member 38, torsion spring 46 releases its energy and causes arm support member 38 to rotate in a counter-clockwise direction (from the perspective of FIG. 4) back to the first position where surface 40 is exposed. In some embodiments, suitable stopping members may be included in armrest assembly 22 to prevent rotation of arm support member 38 beyond predetermined limits in either the clockwise or counter-clockwise direction.

In the embodiment illustrated in FIG. 4, and with continuing reference to FIGS. 1-3, armrest assembly 22 also includes an interlock mechanism 52 which can prevent first control device 30 from responding to any inputs while arm support member 38 is in the second position. In the illustrated embodiment, interlock mechanism 52 comprises a cable extending from a lower portion 54 of arm support member 38 to a switch 56. Switch 56 is electrically interposed in a wire 58 that delivers power to first control device 30. Switch 56 is urged by a torsion spring 60 towards a closed position. As arm support member 38 moves to the second position, interlock mechanism 52 will pull on and open switch 56, thus stopping the flow of power to first control device 30 and rendering first control device 30 inoperative. This will prevent first control device 30 from responding to any unintended control inputs in the event that there is inadvertent contact with first control device 30 while a person is accessing second control device 32. In other embodiments, other types of interlock mechanisms are also possible. For example, rather than controlling power as illustrated in these embodiments, the interlock may activate a control signal that notifies the control surface to ignore all touches. This control signal can go directly to the control device or via any system that has access to the control device. Also, the interlock switch may be any device including a mechanical switch, a proximity sensor, an optical sensor, optical encoder, or any device that indicates the position of the arm rest.

Figure 5:
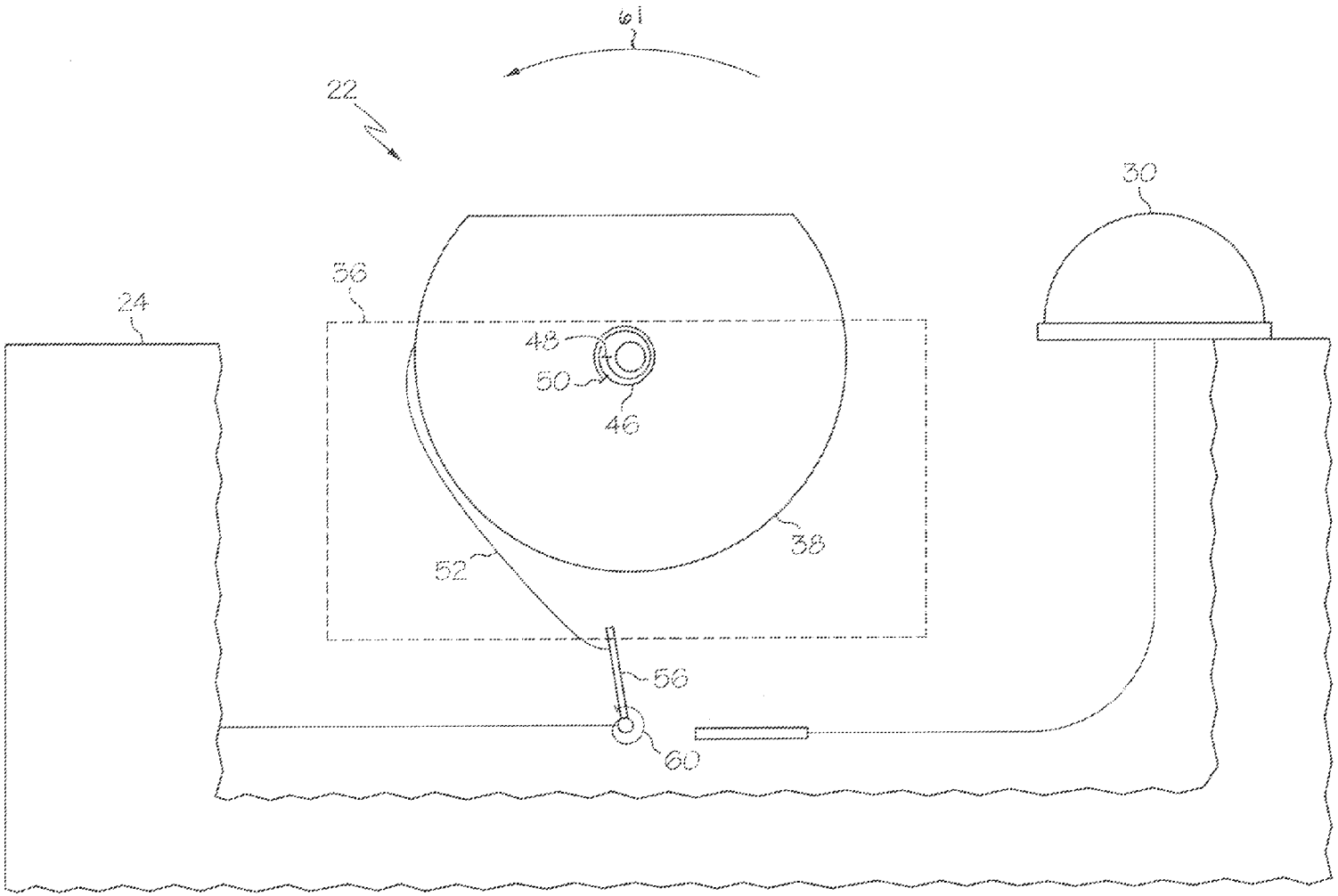
FIG. 5 is a cutaway, schematic side view illustrating the armrest assembly of FIG. 4 with the arm support member in a position to support a user's wrist/forearm.

FIG. 5 is a schematic side view illustrating armrest assembly 22 of FIG. 4 with the arm support member 38 in a position to support a user's wrist/forearm. As illustrated here, arm support member 38 is in position two, and interlock mechanism 52 has opened switch 56, thereby depriving first control device 30 of power. Torsion spring 46 and torsion spring 60 are each storing energy. Torsion spring 46 is urging arm support member 38 towards the first position (i.e., in the direction of arrow 61) and torsion spring 60 is urging switch 56 towards the closed position. When the person lifts their arm off of arm support member 38, the urging of torsion spring 46 will cause arm support member 38 to return to the first position. As arm support member 38 returns to the first position, interlock mechanism 52 will slacken and torsion spring 60 will cause switch 56 to close, thus restoring power to first control device 30.

Figure 6:
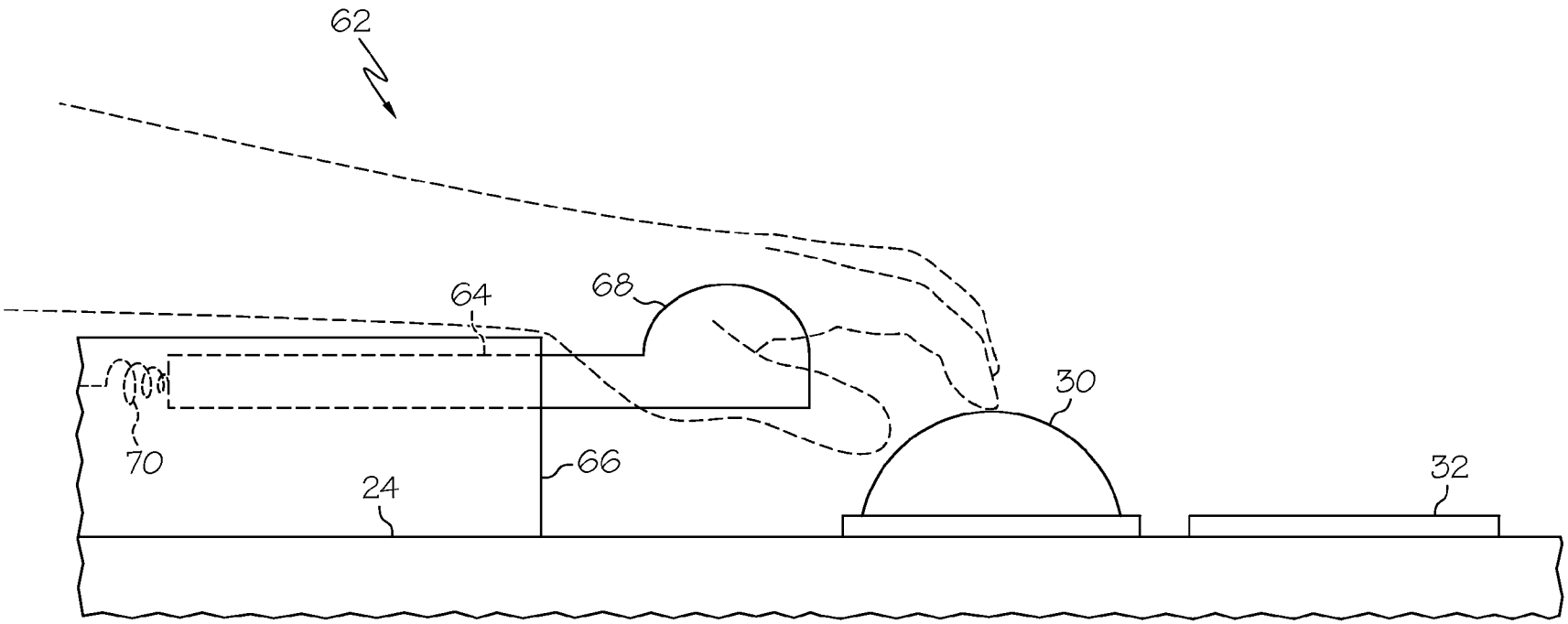
FIG. 6. is a schematic side view of an alternate embodiment of an armrest assembly with the arm support member in a position that supports a user's arm proximate a first control device.

FIG. 6. is a schematic side view of an alternate embodiment of an armrest assembly 62 with an arm support member 64 in a position that supports a user's arm proximate first control device 30. Armrest assembly 62 includes a base member 66 mounted to center pedestal 24. Arm support member 64 is telescopically mounted to base member 66 and is configured to move longitudinally between a first position and a second position. As illustrated in FIG. 6, arm support member 64 includes a convex portion 68 having a convex contour which is configured to accommodate the palm of a person's hand. While in the first position, which is illustrated in FIG. 6, when a person rests the palm of their hand on convex portion 68, their fingers are disposed proximate first control device 30. Armrest assembly 62 further includes a spring 70 connecting arm support member 64 to base member 66.

Figure 7:
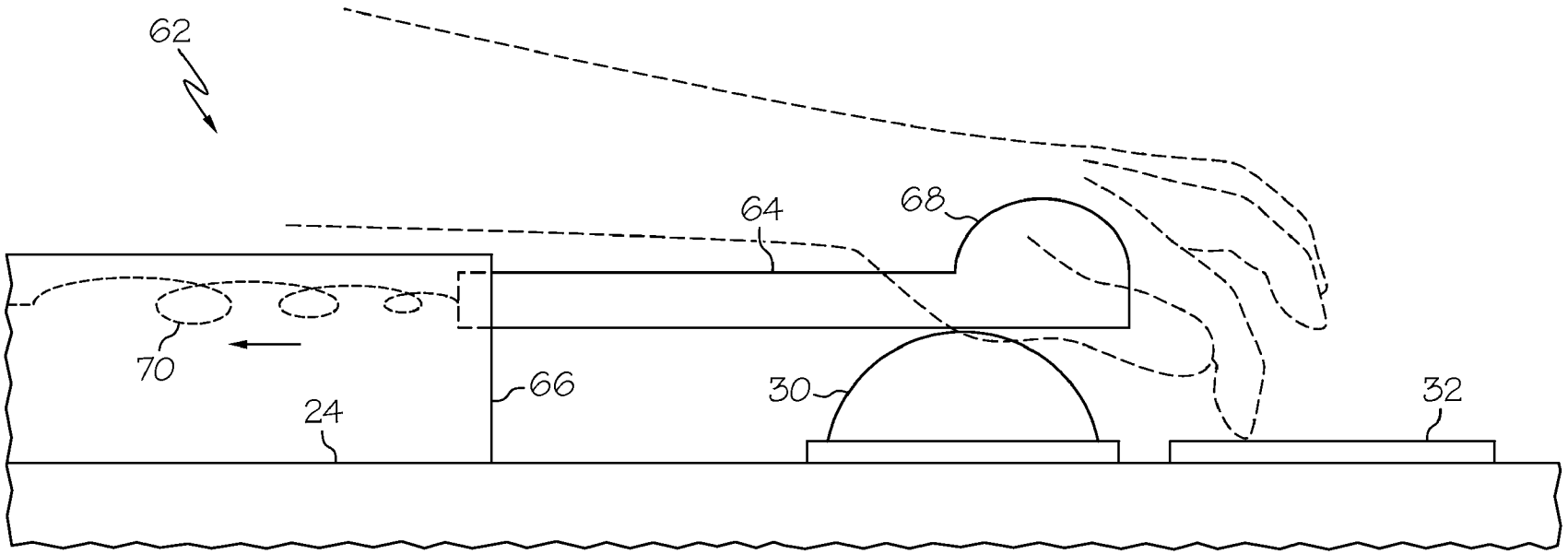
FIG. 7 is a schematic side view of the armrest assembly of FIG. 6 with the arm support member in a position that supports a user's arm proximate a second control device.

FIG. 7 is a schematic side view of armrest assembly 62 with arm support member 64 in a position that supports a person's arm proximate second control device 32. When arm support member 64 is in the second position (as illustrated in FIG. 7) the user's fingers will be positioned to provide inputs into second control device 32. Spring 70 has been stretched and now stores energy. When the person lifts their arm from arm support member 64, arm support member 64 will retract within base member 66 (i.e., return to the first position). Although not illustrated, it should be understood that an interlock mechanism may be fitted to armrest assembly 62.

Figure 8:
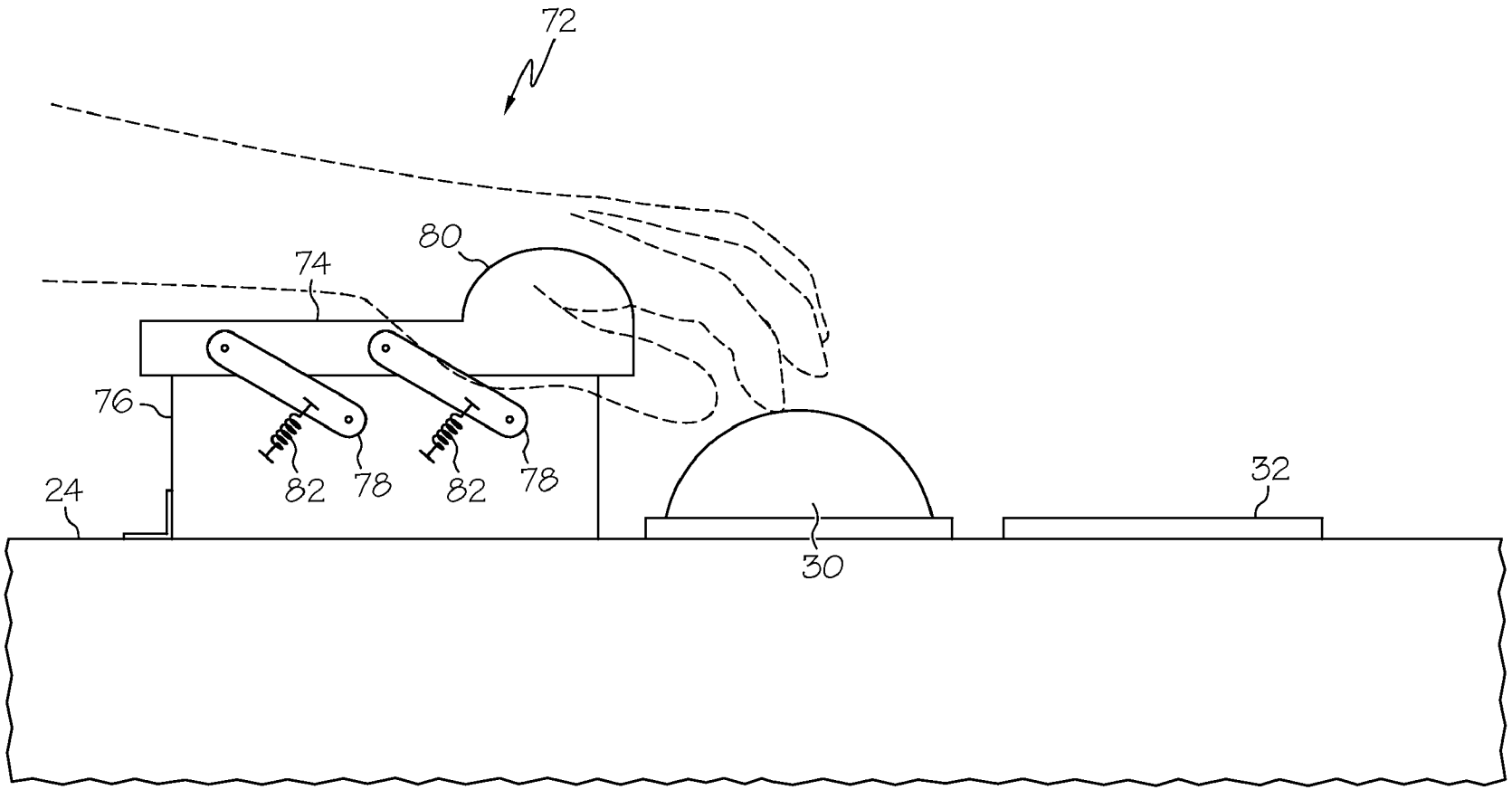
FIG. 8. is a schematic side view of an alternate embodiment of an armrest assembly with the arm support member in a position that supports a user's arm proximate a first control device.

FIG. 8. is a schematic side view of an alternate embodiment of an armrest assembly 72 with an arm support member 74 in a position that supports a user's arm proximate first control device 30. Arm support member 74 includes a convex portion 80 having a convex contour which is configured to accommodate the palm of a person's hand. While in the first position, which is illustrated in FIG. 8, when a person rests the palm of their hand on convex portion 80, their fingers are disposed proximate first control device 30.

Arm support member 74 is connected to a base member 76 via a four bar linkage 78. Two bars of four bar linkage 78 are visible in FIG. 8 and it should be understood that two additional bars link the opposite side of arm support member 74 to the opposite side of base member 76. Four bar linkage 78 permits movement of arm support member 74 in a longitudinal direction towards second control device 32. Springs 82 are connected to four bar linkage 78 in a manner that biases arm support member 74 towards the first position.

Figure 9:
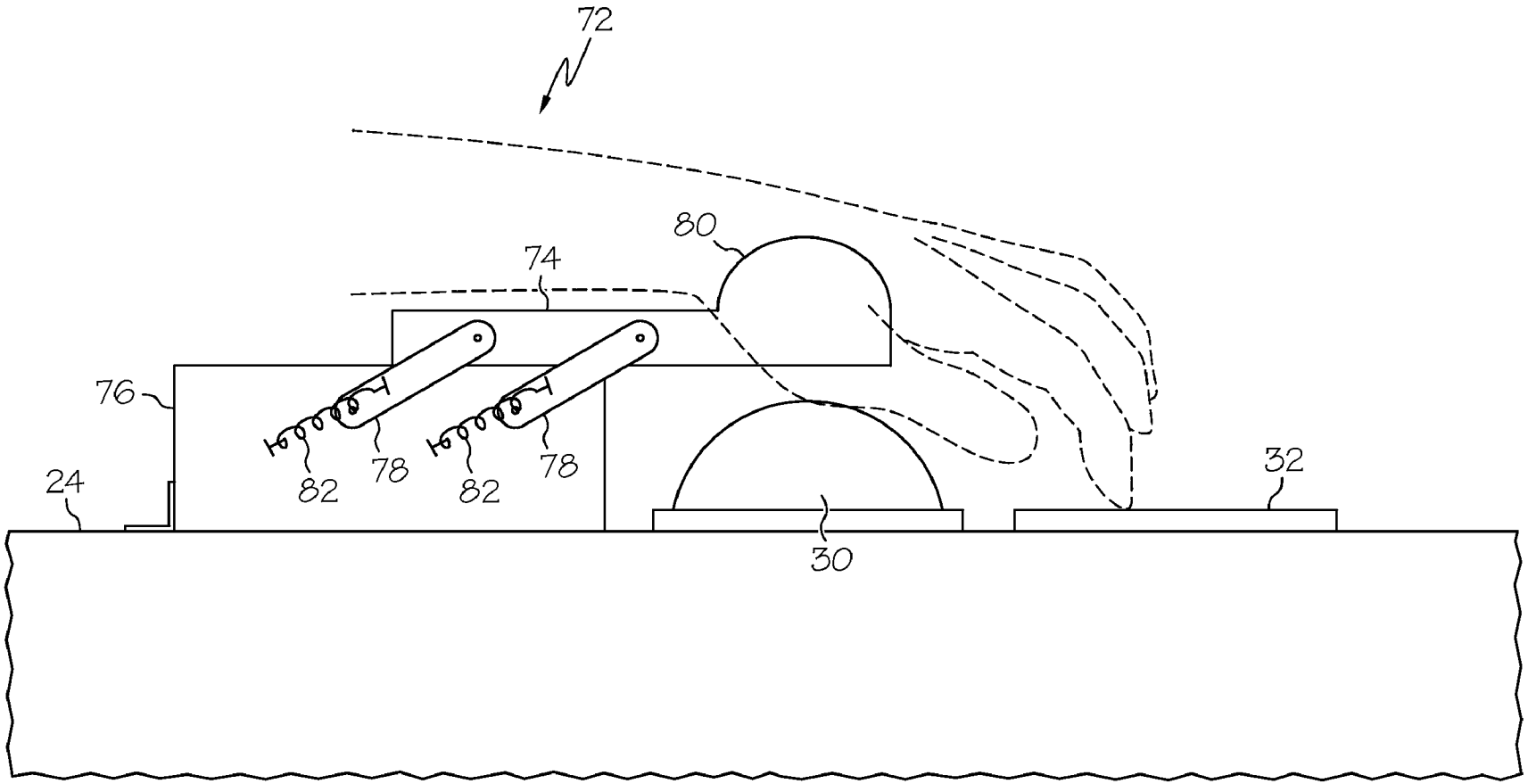
FIG. 9 is a schematic side view of the armrest assembly of FIG. 8 with the arm support member in a position that supports a user's arm proximate a second control device.

FIG. 9 is a schematic side view of armrest assembly 72 with arm support member 74 in a position that supports a user's arm proximate second control device 32. When arm support member 74 is in the second position (as illustrated in FIG. 9) the user's fingers will be positioned to provide inputs into second control device 32. Springs 82 have been stretched and now store energy. When the person lifts their arm from arm support member 74, arm support member 74 will return to the first position. Although not illustrated, it should be understood that an interlock mechanism may be fitted to armrest assembly 72.

Figure 10:
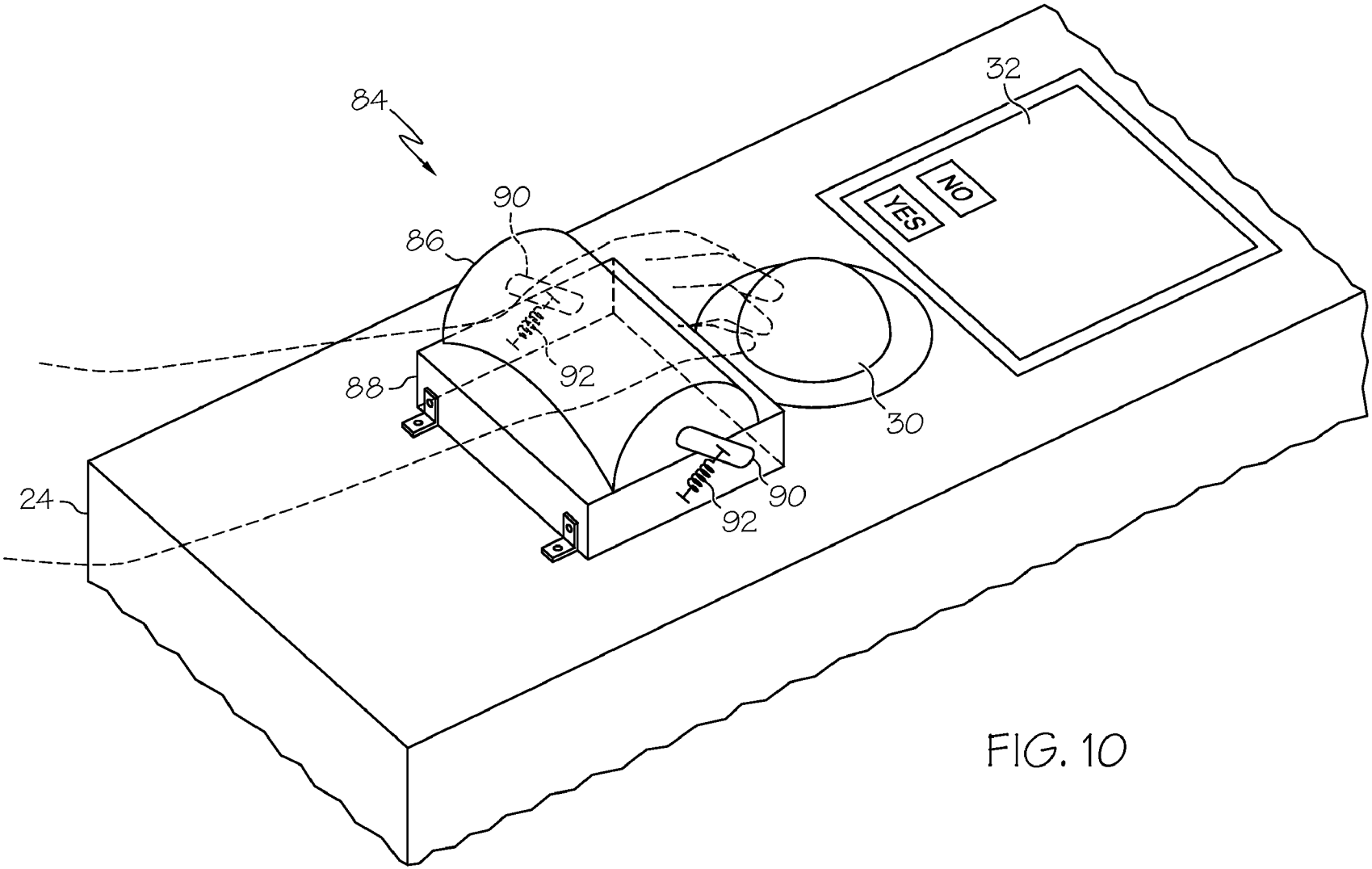
FIG. 10 is a perspective view illustrating an alternate embodiment of an armrest assembly with the arm support member in a position to support a user's palm.

FIG. 10 is a perspective view illustrating an alternate embodiment of an armrest assembly 84 with the arm support member 86 in a position to support a user's palm. Arm support member 86 is movably mounted to a base member 88 via a two bar linkage 90. Further, arm support member 86 is rotatably mounted to two bar linkage 90. Accordingly, arm support member 86 can move longitudinally with respect to base member 88 between a first position (shown in FIG. 10) and a second position (shown in FIG. 11) and can also rotate with respect to two bar linkage 90. When in the first position, a generally convex surface faces upward and is contoured to conform to the palm of a person's hand, as illustrated in phantom lines. When arm support member 86 is in the first position, a person's fingers will be disposed in close proximity to first control device 30, thus facilitating the pilot or co-pilot's ability to stably manipulate first control device 30.

Springs 92 join two bar linkage 90 to base member 88 and bias arm support member 86 towards the first position. As a person moves their arm towards second control device 32 while maintaining contact with arm support member 86, arm support member 86 will both move forward and rotate in a clockwise direction (from the perspective of FIG. 10) and springs 92 will store energy. As arm support member 86 rotates, a surface of arm support member 86 that faces downward in FIG. 11 will rotate into an upward facing position to support the person's arm.

Figure 11:
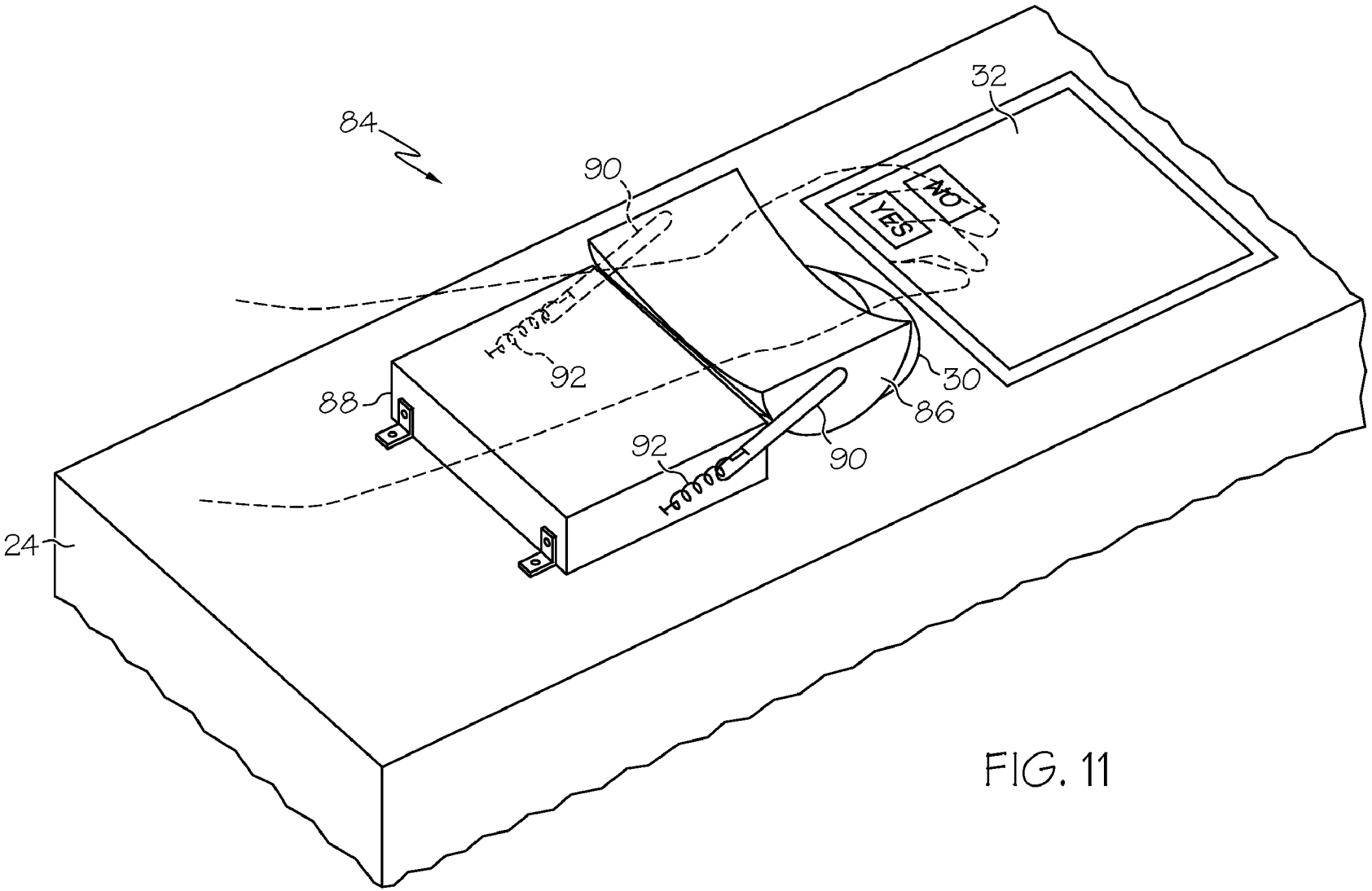
FIG. 11 is a perspective view illustrating the armrest assembly of FIG. 10 with the arm support member in a position to support a user's wrist/forearm.

FIG. 11 is a perspective view illustrating armrest assembly 84 with arm support member 86 in a position to support a user's wrist/forearm. Here, arm support member 86 is shown in the second position where it has moved longitudinally forward, toward second control device 32, and has also rotated such that its generally convex surface (shown in FIG. 10) faces downward and a concave surface now faces upward. The concave surface is contoured such that its shallow portion is longitudinally aligned with first and second control devices 30 and 32. In this manner, arm support member 86 is well suited for supporting a person's wrist or forearm when in the second position. Furthermore, when arm support member 86 is in the second position, it is longitudinally closer to second control device 32 than it is when in the first position. Because arm support member 86 moves longitudinally towards second control device 32, armrest assembly 84 is well suited for supporting a person's arm in a configuration of center pedestal 24 where first and second control devices 30 and 32 are not disposed in close proximity to one another.

When the person lifts their arm from armrest assembly 84, arm support member 86 will move back to the first position under the urging of springs 92. Additionally, interference between a forward surface of base member 88 and a rearward surface of arm support member 86 may cause arm support member 86 to rotate such that its convex surface is once again facing upwards. In other embodiments, one or more torsion springs may be attached to two bar linkage 90 that will store energy when the concave surface faces upwards and that will urge arm support member 86 to rotate back towards a position where its convex surface faces in an upward direction once the person lifts their arm from armrest assembly 84.

Figure 12:
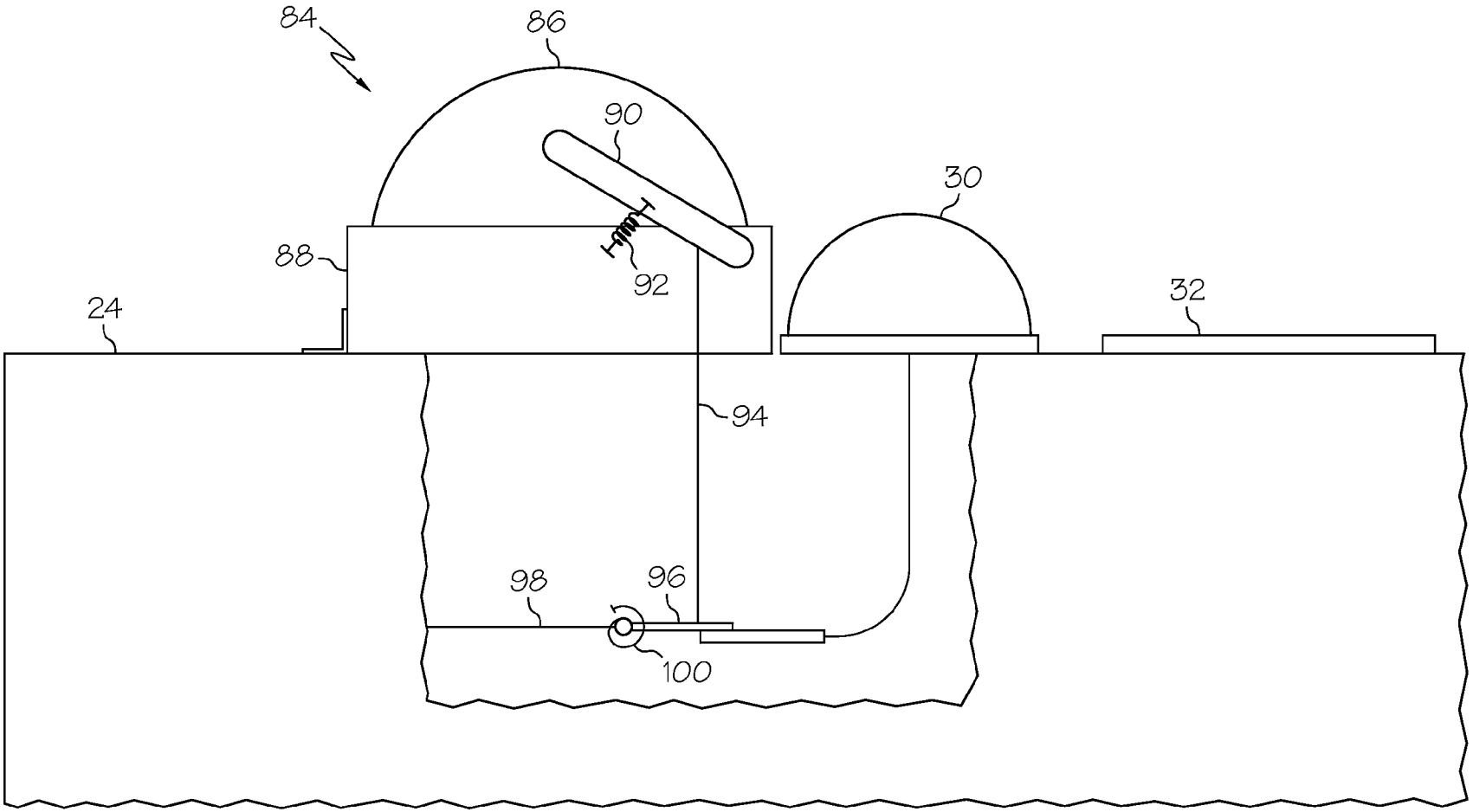
FIG. 12 is cutaway a schematic side view illustrating various features of the armrest assembly of FIG. 10 with the arm support member in a position to support a user's palm.

FIG. 12 is a cutaway, schematic side view illustrating various features of armrest assembly 84 with arm support member 86 in a position to support a user's palm. Armrest assembly 84 includes an interlock mechanism 94. In the illustrated embodiment, interlock mechanism 94 comprises a cable attached at one end to a switch 96 and at an opposite end to two bar linkage 90. Switch 96 is interposed in electrical wire 98 which delivers power to first control device 30. A torsion spring 100 biases switch 96 towards a close state. While arm support member 86 is in the first position, switch 96 stays closed and power flows to first control device 30.

Figure 13:
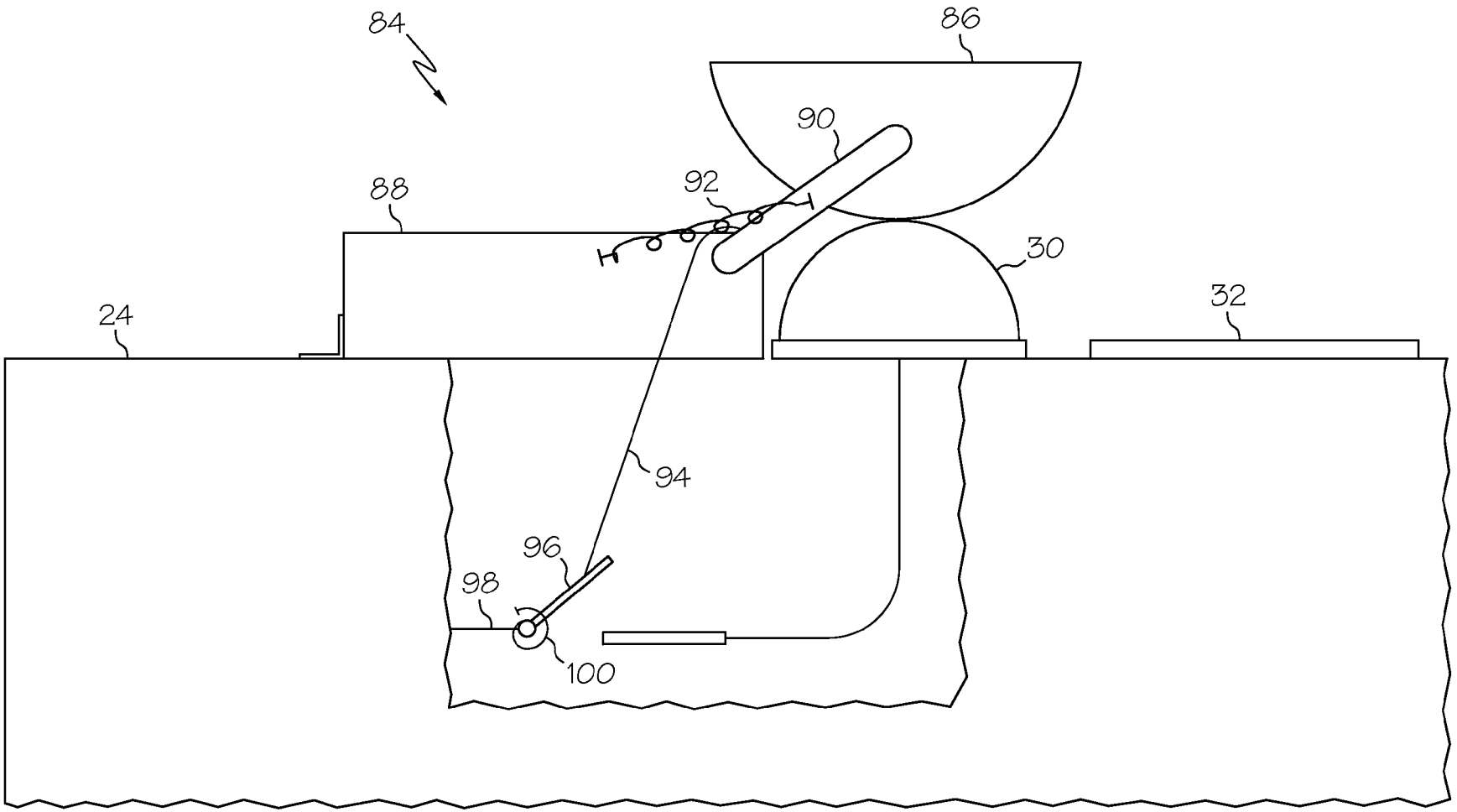
FIG. 13 is a cutaway schematic side view illustrating the armrest assembly of FIG. 12 with the arm support member in a position to support a user's wrist/forearm.

FIG. 13 is a cutaway schematic side view illustrating armrest assembly 84 with arm support member 86 in a position to support a user's wrist/forearm. When arm support member 86 is in the second position, interlock mechanism 94 pulls switch 96 open, preventing the flow of electricity through electrical wire 98 and thus depriving first control device 30 of power. This prevents any inadvertent contact with first control device 30 from resulting in any inadvertent control inputs being input into a system controlled by first control device 30.

In embodiments equipped with interlock mechanism 94, such the one illustrated in FIG. 13, first control device 30 may serve to support arm support member 86 while it is the second position. When arm support member 86 is disposed in the second position, springs 92 stores energy torsion and urges arm support member 86 back towards the first position. Additionally, when arm support member 86 is disposed in the second position, torsion spring 100 stores energy and urges switch 96 back towards a closed state. When the pilot or co-pilot lift their arm from armrest assembly 84, spring 92 will move arm support member 86 back to the first position and torsion spring 100 will close switch 96, thus restoring the flow of electricity to first control device 30.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An armrest assembly for use with a first control device and a second control device arranged generally in a tandem configuration, the armrest assembly comprising:

a base member configured for mounting to a surface proximate the first control device in a position generally longitudinally aligned with the first control device and the second control device;

an arm support member movably mounted to the base member, the arm support member configured to move between a first position and a second position, the arm support member configured to steady a user's arm while accessing the first control device when the arm support member is in the first position, and the arm support member being further configured to steady the user's arm while accessing the second control device when the arm support member is in the second position; and a biasing member connected to the arm support member and configured to bias the arm support member towards the first position.

2. The armrest assembly of claim 1, further comprising an interlock mechanism connected to the arm support member, the interlock mechanism being configured to render the first control device incapable of responding to control inputs while the arm support member is in the second position.

3. The armrest assembly of claim 1, wherein the arm support member is telescopically mounted to the base member.

4. The armrest assembly of claim 1, wherein the arm support member is mounted to the base member via a four bar linkage.

5. An armrest assembly for use with a first control device and a second control device arranged generally in a tandem configuration, the armrest assembly comprising:

a base member configured for mounting to a surface proximate the first control device in a position aligned generally longitudinally with the first control device and the second control device; and an arm support member rotatably mounted to the base member, the arm support member configured to rotate between a first position and a second position, the arm support member configured to steady a user's arm while accessing the first control device when the arm support member is in the first position, and the arm support member being further configured to steady the user's arm while accessing the second control device when the arm support member is in the second position, wherein the arm support member has a first surface and a second surface, wherein the first surface is positioned on the arm support member to support a first portion of the user's arm when the arm support member is in the first position and wherein the second surface is positioned on the arm support member to support a second portion of the user's arm when the arm support member is in the second position.

6. The armrest assembly of claim 5, wherein the first surface is contoured in a manner that accommodates the first portion of the user's arm and wherein the second surface is contoured in a manner that accommodates the second portion of the user's arm.

7. The armrest assembly of claim 6, wherein the first surface has a generally convex configuration and wherein the second surface has a generally concave configuration.

8. The armrest assembly of claim 5, further comprising a biasing member connected to the arm support member and configured to bias the arm support member towards the first position.

9. The armrest assembly of claim 8, wherein the biasing member comprises a torsion spring.

10. The armrest assembly of claim 5, further comprising an interlock mechanism connected to the arm support member, the interlock mechanism being configured to render the first control device incapable of responding to control inputs while the arm support member is in the second position.

11. An armrest assembly for use with a first control device and a second control device arranged generally in a tandem configuration, the armrest assembly comprising:

a base member configured for mounting to a surface proximate the first control device in a position generally longitudinally aligned with the first control device and the second control device; and an arm support member mounted to the base member via a two bar linkage and configured to move between a first position and a second position, the arm support member configured to steady a user's arm while accessing the first control device when the arm support member is in the first position, and the arm support member being further configured to steady the user's arm while accessing the second control device when the arm support member is in the second position.

12. The armrest assembly of claim 11, wherein the arm support member moves towards the second control device when the arm support member moves from the first position to the second position.

13. The armrest assembly of claim 11, wherein the arm support member is further configured to rotate with respect to the two bar linkage, wherein the arm support member rotates with respect to the two bar linkage when moving between the first position and the second position, wherein the arm support member has a first surface and a second surface, wherein the first surface is positioned on the arm support member to support a first portion of the user's arm when the arm support member is in the first position and wherein the second surface is positioned on the arm support member to support a second portion of the user's arm when the arm support member moves to the second position.

14. The armrest assembly of claim 13, wherein the first surface is contoured in a manner that accommodates the first portion of the user's arm and wherein the second surface is contoured in a manner that accommodates the second portion of the user's arm.

15. The armrest assembly of claim 14, wherein the first surface has a generally convex configuration and wherein the second surface has a generally concave configuration.

16. The armrest assembly of claim 11, further comprising an interlock mechanism connected to the arm support member, the interlock mechanism being configured to render the first control device incapable of responding to control inputs while the arm support member is in the second position.

17. The armrest assembly of claim 16, wherein the arm support member is partially supported by the first control device when the arm support member is in the second position.

18. The armrest assembly of claim 11, further comprising a biasing member connected to the arm support member and configured to bias the arm support member towards the first position.

* * * * *